United States Patent [19]

Sato

[11] 3,997,125

[45] Dec. 14, 1976

BEST AVAILABLE COPY

[54] CORE FOR LABEL STRIP

[75] Inventor: Yo Sato, Tokyo, Japan

[73] Assignee: Kabushiki Kaisha Sato Kenkyusho, Tokyo, Japan

[22] Filed: Jan. 20, 1976

[21] Appl. No.: 650,622

[30] Foreign Application Priority Data

Jan. 28, 1975 Japan ..... 50-11980[U]

[52] U.S. Cl. ..... 242/68.5

[51] Int. Cl.[2] ..... B65H 17/02

[58] Field of Search ..... 242/68.5, 68, 68.1, 242/68.3, 55, 68.6; 156/384, 591, 584

[56] References Cited

UNITED STATES PATENTS

| | | | |
|---|---|---|---|
| 2,693,918 | 11/1954 | Bretson | 242/68.5 |
| 2,788,944 | 4/1957 | Krueger | 242/68 X |
| 2,904,277 | 9/1959 | Underwood | 242/68.5 |
| 3,799,470 | 3/1974 | Gavere | 242/68.5 |
| 3,836,090 | 9/1974 | Mix | 242/68.5 |
| 3,860,191 | 1/1975 | Geri | 242/68.5 |

*Primary Examiner*—Edward J. McCarthy
*Attorney, Agent, or Firm*—Ostrolenk, Faber, Gerb & Soffen

[57] ABSTRACT

A core used for a rolled label strip, which core can be easily and detachably mounted on the rotary core supporting structure of a portable labeling machine; the core comprises a hollow cylindrical body having: an outer cylindrical surface on which a label strip is rolled; a circular radially wider end face; a circular radially narrower width end face opposite to the wider end face; a fitting surface formed on the rear side of the wider end face and inside the core; and an inner bore formed between the wider end face and the fitting surface; recesses for preventing idle rotation and raised surfaces for engaging cooperating recesses are formed on the wider end face of the core; other recesses to be engaged with the raised surfaces of an adjacent core are formed on the narrower end face of the core so as to facilitate an operation of subdividing a web of labels into a number of elongated strips; also disclosed is a mandrel arrangement by which a web of labels is wound on a plurality of adjacent cores and the web is subdivided into individual strips on each core; also disclosed is a supporting structure for the core and means for controlling rotation of the core.

12 Claims, 14 Drawing Figures

CORE FOR LABEL STRIP

BACKGROUND OF THE INVENTION

This invention relates to a core for a rolled label strip that is used on a hand held portable labeling machine. It also relates to means for winding a label strip on the core. It further relates to a structure for supporting a core on a labeling machine.

The label strip is comprised of a plurality of same-sized pre-cut labels and a backing strip which carries the labels. The labels with adhesive on their back sides are applied on said backing strip in side by side relation. The label strip is rolled on a core to form a rolled label strip which is to be attached to a supporting structure mounted in the machine frame or on an extended portion of the machine frame of a hand labeler.

By continual operation of the hand labeler, the label strip is paid out from the label supporting structure, the labels on the label strip are printed, the printed labels are then peeled off from the backing strip and the peeled labels are applied to the surfaces of desired articles. When this series of operations has been repeated enough times, the rolled label strip is used up and it must be replaced with a new one.

In the prior art, the label strips are rolled on a core that is in the form of a simple cylindrical pipe, which is made of paper material or synthetic plastic. When the core is attached on a core support in the labeler, the end faces of the core are held between flexible plastic arms of the core support. In the hand labeler of the above-mentioned type, when the friction between the side faces of the core and the arms of the core support is too large, the resistance to rotation of the core becomes so large that the label strip is liable to be torn off when it is pulled out.

Further, in this type of core support the arm on one side is habitually forced open in the replacement of an empty rolled label strip. The arm is excessively and repeatedly bent beyond what its flexibility would permit. Therefore, the arm is often deformed or damaged and the labeler becomes not serviceable.

In another type of core support, a supporting mandrel detachably fitted to the machine frame is inserted into the above-mentioned cylindrical core to support a rolled label strip. The supporting mandrel is liable to be lost, and if that occurs, the rolled label strip cannot be attached and thus the labeler cannot be used.

In another type of core support, the machine frame is integrally provided with a cantilever shaft which is loosely inserted into a core. When the cover for preventing unrolling is taken off, the rolled label strip slips off from the shaft and drops on the floor. Therefore, the label strip is unrolled.

When labels are applied to the surfaces of articles, it is necessary to swing the hand labeler up and down like a hammer. This accelerates the label advancing action and the core is excessively rotated in the advancing direction. As a result, the label strip is unrolled and loosened which results in abnormal working of label advancing, printing, peeling and applying and the labeler gets out of order.

Accordingly, a rolled label strip supporting device which does not allow free rotation of the label strip when the labeler is vigorously moved and which constantly tensions the label strip during the advancing of the label strip and the provision of an improved core fitted to such a supporting device, are eagerly desired.

BRIEF SUMMARY OF THE INVENTION

In order to eliminate the above-mentioned disadvantages, the primary object of the present invention is to provide a core for a label strip which is serviceable on and promotes hand labeler operation.

A further object of the present invention is to provide an improved core for a rolled label strip, which core is detachably mounted on and operatively interconnected to the supporting member of a supporting structure in the machine frame of a hand labeler or on the extended portion of the machine frame of a hand labeler.

Still a further object of the present invention is to provide a core for a label strip which is serviceable in connection with the winding of a number of label strips from a subdivided large web or sheet of labels.

Another object of the present invention is to enable the cores to have label strips wound on them.

It is yet another object of the present invention to adequately support and control rotation of the core.

In view of the above-mentioned objects, the rolled label strip core of the present invention is in the shape of a hollow cylindrical body and comprises an outer cylindrical surface on which a label strip is rolled; a circular wide end face perpendicular to the axis of said cylindrical body; a circular narrow end face also perpendicular to the axis of said cylindrical body and being on the opposite side of the core to the wide end face; a fitting surface formed on the rear side of the wide end face; and an inner bore formed between the wide end face and said fitting surface, the bore having a diameter smaller than the inner diameter of said cylindrical body and being concentric with said wide and narrow end faces of the core.

Further, in accordance with the present invention, the core of the present invention is provided on its end faces with recesses which are engageable by the core support for preventing idle rotation of the core. The core is also provided with raised surfaces which cooperate and mate with recesses in the adjacent core. This is useful in connection with the winding onto separate cores of separate strips of labels from a subdivided web of labels. Ribs which are parallel to the axis of the core and have the same radial height as the inner surface of the inner bore of the core are formed on the inside surface of the core. This is also useful in connection with the winding of label strips from a subdivided label web.

The cores may be wound with label strips that are taken from a subdivided web of labels. To do this, the cores are slid onto a mandrel. The raised surfaces on the wider end face of a core nest in the recesses in the narrower end face of the next adjacent core. Then a respective subdivided label strip is wound on each core as the cores are wound together on the mandrel.

There is also a core support structure on the labeling machine which supports the core and permits it to be rotated. The core is engaged by a rotatable disk which in turn carries pawl means on its periphery. The pawl means engage a toothed ratchet surface on an annular wall on the labeling machine and the ratchet surface controls rotation of the disk and the core.

BRIEF DESCRIPTION OF THE DRAWINGS

These and other objects and features of the present invention will become apparent from the following description taken in connection with the accompanying drawings, in which:

FIG. 4*b* is a cross-sectional view of the core taken along line B—B in FIG. 4a;

DETAILED DESCRIPTION OF THE PREFERRED EMBODIMENT

Figure 1:
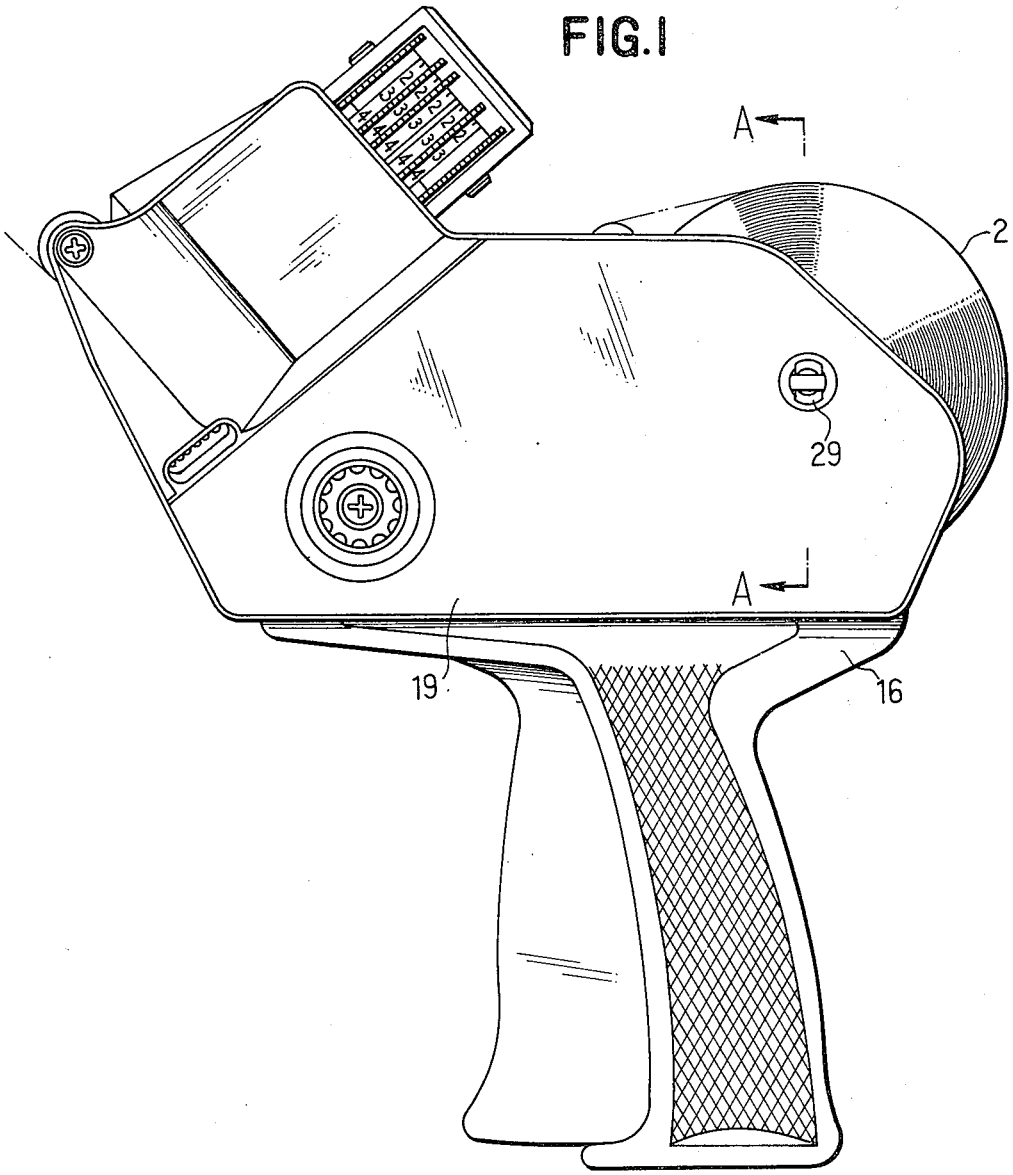
FIG. 1 is a side view of the labeler to which the core of the present invention carrying a rolled label strip is attached.
Figure 2:
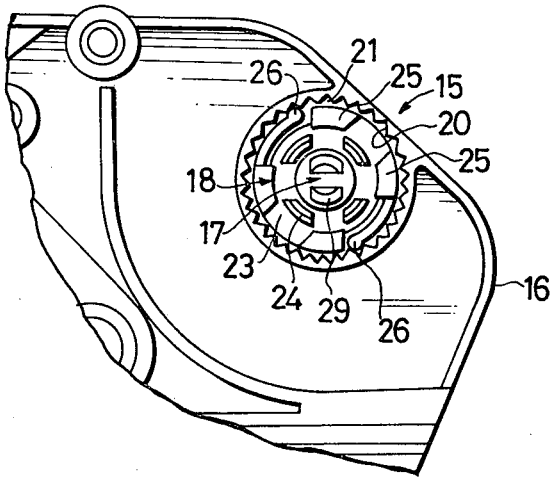
FIG. 2 is a side view of the core supporting structure for supporting the core of the present invention.
Figure 3:
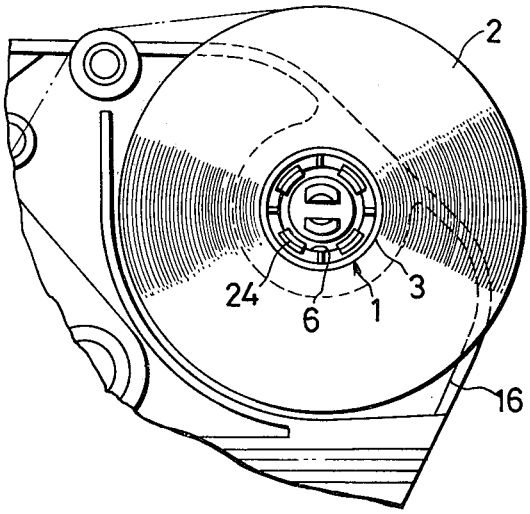
FIG. 3 is a partial side view of the labeler in which an unrolling preventing plate is taken off and the core carrying a rolled label strip is attached to the label supporting structure.
Figure 4A:
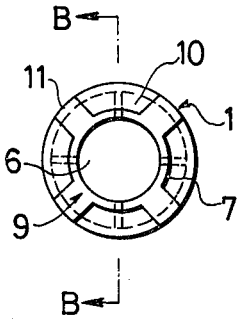
FIG. 4*a* is a side elevational view of the core of the present invention.
Figure 4B:
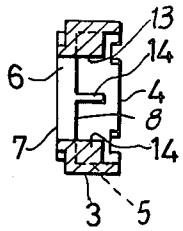
Figure 4C:
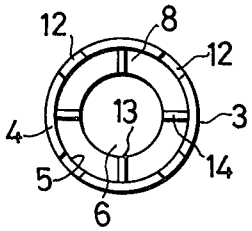
FIG. 4*c* is a side elevational view of the core from the direction of view opposite that of FIG. 4*a;*
Figure 5:
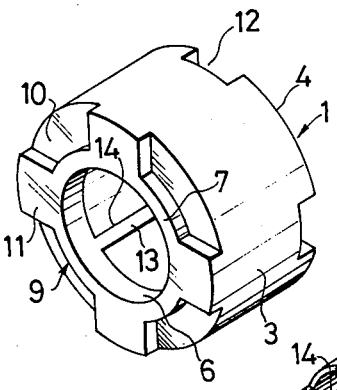
FIG. 5 is a perspective view of the core.

Referring to the accompanying drawings, an embodiment of the present invention is now described.

As shown in FIGS. 4*a*, 4*b*, 4*c* and 5, a cylindrical core 1 has an outer surface 3 on which a label strip 2 is rolled. The core 1 includes a fastening section 9 at one end thereof which section comprises a radially relatively wider end face 7, a radially relatively narrower end face 4 at the opposite end of the core, a fitting surface 8 that is formed on the rear side of said wide end face 7 and inside the core, and an inner bore 6 which extends from the wide end face 7 to the fitting surface 8. Further, the diameter of the inner bore 6 is smaller than the diameter of the inside surface 5 of the core outer surface 3 and the axis of the bore 6 is identical to the axis of the cylindrical core.

On the peripheral portion of the core wide end face 7 and extending radially inwardly from outer surface 3 only partially toward bore 6, a plurality of generally fan-shaped arcuate recesses 10 are formed. Preferably, each recess is paired with a diametrically opposed one. The recesses prevent idle running, as discussed below. The remaining portions of end face 7 form raised surfaces 11 between adjacent recesses 10. Raised surfaces 11 are useful in connection with the subdividing of label webs into label strips, as discussed below.

On the other narrow end face 4, a plurality of recesses 12 are formed which are shaped and positioned so as to be engaged with the raised surfaces 11 of an adjacently positioned core 1, when the cores are positioned adjacent to each other during the label subdividing process. The inside surface 5 of core 1 is provided with a plurality of radially inwardly projecting core ribs 14 which have top surfaces 13 that are aligned with the inside surface of the inner bore 6 and that extend parallel to the axis of core 1.

Although the core 1 is shown having four raised surfaces 11 and four recesses 12, the numbers of them are not restricted to the embodiment illustrated.

The label strips 2 are rolled on the outer surfaces 3 of cores 1.

Figure 12:
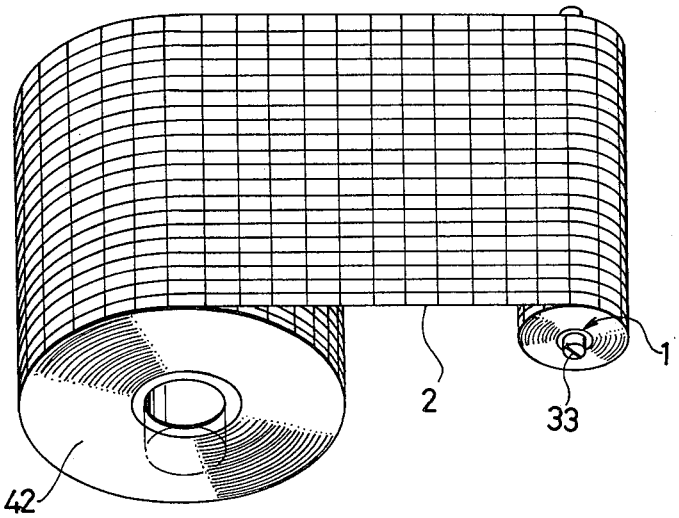
FIG. 12 is a schematic view showing the subdividing of a web of label strip.
Figure 11:
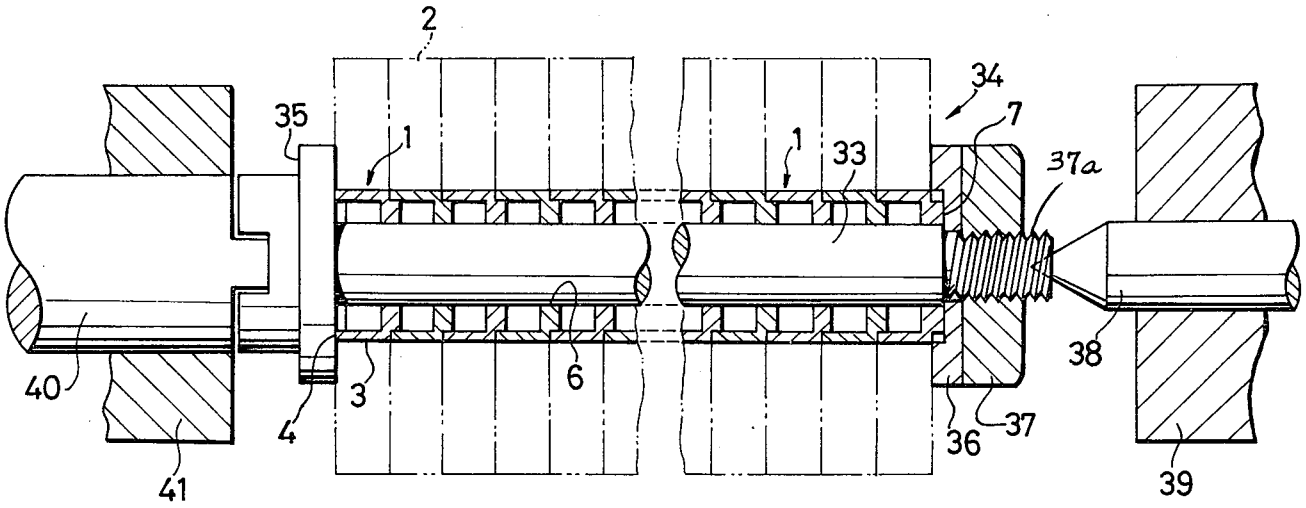
FIG. 11 is a partial cross-sectional view of a subdividing apparatus in which a plurality of cores are fitted to the mandrel of said apparatus.

As shown in FIGS. 11 and 12, for label strip roll manufacturing, a mandrel 33 having an axis along its length is inserted through the inner bores 6 of a plurality of cores 1. The cores 1 are assembled together on the mandrel with the raised surfaces 11 and recesses 12 of adjacent cores being nested in engagement with each other. Therefore, the cores 1 can be rotated together by mandrel 33.

In order to smoothly guide the mandrel 33 through the inner bores 6 of the cores 1, to stabilize the cores against rocking and to facilitate the engagement of each core 1 with adjacent cores, the cores 1 are provided with the above described inside ribs 14. Mandrel 33 is part of the label web device 34. Mandrel 33 is supported and guided at one end by flange 35. Washer 36 engages the other end of mandrel 33 and washer 36 and thus mandrel 33 is held in place by clamping nut 37 which is tightened onto a screw threaded end portion 37*a* of mandrel 33. Center shaft 38 supports the mandrel 33 and center shaft 38 rides in bearing 39. Mandrel rotating shaft 40 rides in bearing 41.

As shown in FIGS. 1, 2, 6 and 10, the core 1 supporting and label strip 2 supporting structure 15 of the generally gun-shaped hand labeler, comprises a labeler casing 16, a spindle 17 firmly and nonrotatably attached to the casing 16, a core supporting member 18 pivotally fitted to and rotatable with respect to the spindle 17, and a cover 19 for preventing unrolling of the label strip 2.

Formed on the inside of casing 16 is a circular recess 21 which has a notched or toothed ratchet surface 20 on its inner periphery. A hole 22, which is concentric with circular recess 21 and has a smaller diameter, passes through casing 16. Core supporting member 18 is placed inside recess 21.

The core supporting member 18 is an integral unit comprised of a disk 23, hooks 24, securing projections 25 and controlling pawls 26. A hole 27 is formed at the center of disk 23. A plurality of the hooks 24 are integrally attached to and project from one face of disk 23 and the hooks are arrayed on a concentric circle with and are radially spaced from hole 27. Hooks 24 are preferably arranged in pairs of oppositely positioned hooks. Hooks 24 are made flexible. The hooks are so placed on disk 23 and are so shaped that the outer diameter defined by the outer tips of the hooks 24 is slightly larger than the inner diameter of the bore 6 of core 1. Furthermore, the hooks 24 are provided with latches 28 on their outer surfaces near their tips. The outer diameter defined by the outer ends of the latches 28 is also slightly larger than the inner diameter of bore 6 of core 1. Both of the securing projections 25 and the flexible controlling pawls 28 are integrally attached to and arrayed around the disk 23 in oppositely positioned pairs, respectively.

Figure 6:
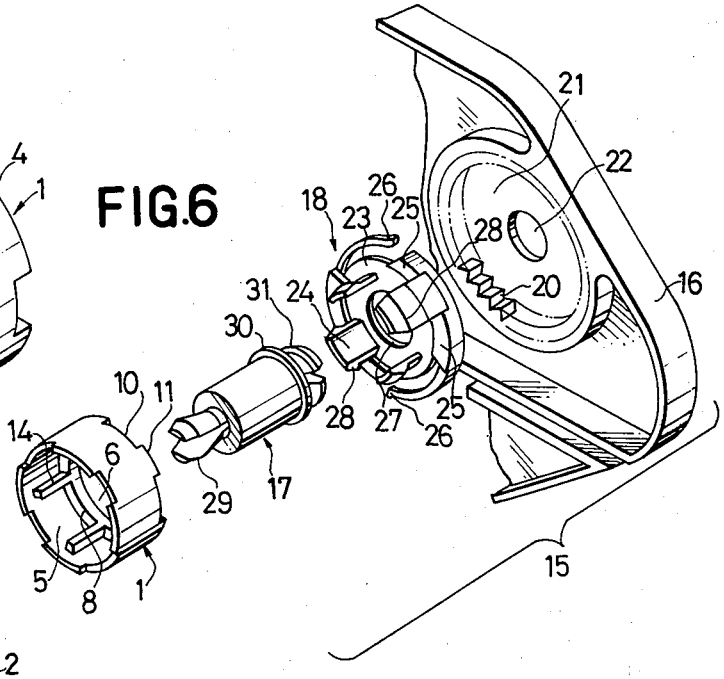
FIG. 6 is an exploded view of the core and its supporting structure.
Figure 7:
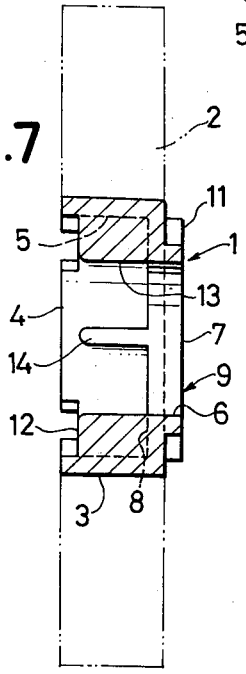
FIG. 7 is a vertical sectional view of the core carrying a label strip thereon.
Figure 8:
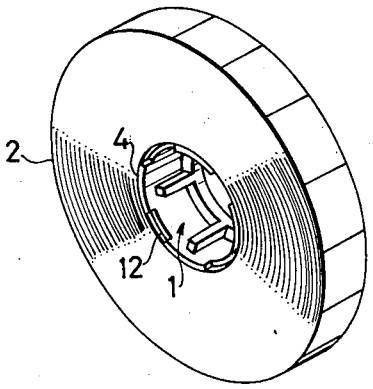
FIG. 8 is a perspective view of the core carrying a label strip thereon.

On one end of spindle 17, flexible, normally radially outwardly biased hooks 29 are formed. On the other end of spindle 17, a flange 30 is formed. Extending also from the other end of the spindle beyond the flange 30 are other flexible hooks 31 which are separated from flange 30 by an annular grooved portion 31*a*. The spindle 17 is moved into the hole 27 of the core supporting member 18 until flange 30 engages disk 23. The hooks 31 have an inclined exterior and the hooks 31 are forced radially inwardly as they are forced through to engage hole 22 of the casing 16 until the peripheral wall of hole 22 engages in grooved portion 31*a*. The spindle 17 is thereby attached to the casing 16. The disk 23 of the core supporting member 18 rests between the flange 30 of the spindle 17 and the inner surface of the casing 16. The controlling pawls 26 which are connected to and positioned above the periphery of disk 23 are caused to engage with the internal notched surface 20 of the circular recess 21. Pawls 26 are resilient to exert proper pressure upon surface 20. By this means, the rotation of the core supporting member 18 is restrained to some extent. As shown in FIG. 6, pawls 26 prohibit clockwise rotation of core 1 and inhibit counterclockwise rotation except when the label strip is to be unrolled.

Figure 9:
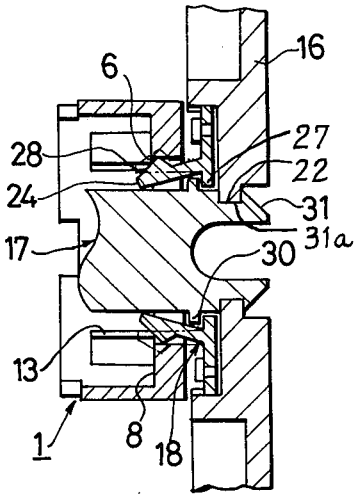
FIG. 9 is a cross-sectional view of the core supporting structure to which the core is being attached.
Figure 10:
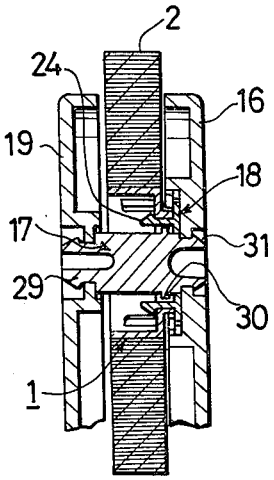
FIG. 10 is a cross-sectional view taken along the line A—A in FIG. 1.

As shown in FIG. 9, the hooks 24 of the core supporting member 18 are fitted into the internal bore 6 of the core 1. Then the securing recesses 10 in the core 1 and the securing projections 25 on the supporting member 18 are aligned. The walls defining the internal bore 6 contact the latches 28. Then the core 1 is pushed forward which bends the hooks 24 radially inward. The latches 28 return to their normal positions due to their elasticity when they have moved through bore 6 sufficiently to engage with the fitting surface 8 of the core 1. In this manner, the rolled label strip 2 is firmly attached to the core supporting member 18.

To remove the core 1, it is axially pulled. It can easily be taken off the core supporting member 18 because the latches 28 are inclined on their rear (right side in FIG. 9) surfaces so that they cause their respective hooks to bend inwardly due to the elasticity of the hooks.

In the above described embodiment, the numbers of the recesses 10, raised surfaces 11 and other recesses 12 of the core 1 are respectively four. However, the present invention is not restricted to such number for any of these elements. However many such elements there are, care should be taken that the positions of recesses 10 of the core 1 correspond to those of the securing projections 25 of the core supporting member 18 and further that the positions of the raised surfaces 11 of the core 1 correspond to the positions of the recesses 12 of other cores 1 to be engaged.

Furthermore, although a gun-shaped labeler having a core supporting structure 15 within its casing has been illustrated, the use of the core of the present invention is not restricted to this. For example, the labeler of the type in which a core supporting device is mounted on extended arm plates above the machine frame or any other sort of labeler capable of supporting core 1 in the manner described herein may be provided with the device of the present invention.

Also, the core supporting structure of the labeler is not restricted to the above embodiment and similar devices performing similar functions can be used to support the core of the present invention.

As disclosed in the above, the attaching and detaching of core 1 of the present invention to the core supporting structure 15 is very easy, and the core 1 rotates along with the core supporting member 18 of the supporting structure 15. Therefore, when the core 1 is held by the core supporting member 18, the excessive turning, slipping off, and releasing of a label strip can be prevented because undesired rotation of core 1 can be prevented. Thus the labeler can be used in good order. Furthermore, when label strips 2 are rolled on the cores 1, the subdividing of a web of label strips can be performed smoothly since the cores 1 of the present invention may be firmly joined together on a mandrel.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. A core for a label strip, said core comprising:
a hollow cylindrical body, including:
an outer cylindrical surface on which a label strip is to be rolled; said cylindrical body and cylindrical surface having a common axis;
a first end face at one end of said cylindrical body and oriented perpendicular to said axis and facing outwardly of said cylindrical body; said first end face having a relatively wider radial width;
a second end face at the opposite end of said cylindrical body and oriented perpendicular to said axis and facing outwardly of said cylindrical body; said second end face having a relatively narrower radial width;
a fitting surface inside said cylindrical body and facing in the opposite direction from and spaced from said first end face;
an inner bore in and defined by the interior of said cylindrical body and extending between said first end face and said fitting surface;
said cylindrical body having an interior surface between said second end face and said fitting surface; said inner bore having a diameter that is smaller than the diameter of said cylindrical body interior surface; said bore being coaxial with said cylindrical body.

2. A core for a label strip as claimed in claim 1, wherein said first end face comprises an annular ring that radially extends between said bore and said cylindrical surface; said second end face comprises an annular ring that radially extends between said cylindrical body interior surface and said cylindrical surface.

3. A core for a label strip as claimed in claim 2, further comprising:
at least one recess defined in said first end face and which projects into that face toward said fitting surface; at least one raised surface projecting above said first end face and away from said fitting surface;
at least one recess defined by walls and being formed in said second end face and said recess projecting into said second face; said narrower end surface recess being shaped to receive and such that said walls of that said recess can engage a said raised surface of said first end face.

4. A core for a label strip as claimed in claim 3, wherein there are a plurality of said recesses and a plurality of said raised surfaces at said first end face; said recesses alternate with said raised surfaces annularly around said first end face.

5. A core for a label strip as claimed in claim 4, wherein each said recess on said first end face extends radially from said cylindrical surface only partially to said inner bore and said first end face recesses being generally fan shaped.

6. A core for a label strip as claimed in claim 4, further comprising a plurality of ribs projecting above said cylindrical body interior surface, extending parallel to said cylindrical body axis, arrayed annularly around said cylindrical body and projecting to a height above said cylindrical body interior surface such that the tops of said ribs have the same height above said cylindrical body interior surface as said inner bore has.

7. A core for a label strip as claimed in claim 4, wherein there are a plurality of the said recesses on said second end face, and the number of those said recesses on said second end face corresponds to the number of said raised surfaces on said first end face; said raised surfaces each being identical in size to a correspondingly positioned said recess on said second end face.

8. In combination, a plurality of said cores for a label strip as claimed in claim 7, and a mandrel;

said mandrel having an axis extending along its length; said mandrel and its said axis passing through said bores of all said cores; said cores being positioned in engagement with adjacent said cores such that the said raised surfaces on said first end face of each said core engage and are fitted into said recesses on said second end face of the adjacent said core;

means for rotatively supporting said mandrel such that it may be rotated about its said length axis.

9. The combination of claim 8, further comprising in each said core a plurality of ribs; said ribs of each said core project above said cylindrical body interior surface, extend parallel to said cylindrical body axis, are arrayed annularly around said cylindrical body and project to a height above said cylindrical body interior surface such that the tops of said ribs have the same height above said cylindrical body interior surface as said inner bore has; said ribs of each said core engaging said mandrel.

10. In combination, a core for a label strip as claimed in claim 7 and a supporting structure therefor;

said supporting structure comprising:

a spindle passing through said core and having a diameter smaller than that of said core inner bore; a spindle nonrotation support for said spindle;

a core support positioned in opposed relationship to said core first end face;

resilient hooks extending from said core support and into the annular space between said core bore and said spindle; said hooks being so shaped and positioned and being biased to resiliently engage and hold said core to said core support and in position on said spindle, and said hooks being adapted to resiliently deflect and deform to enable release therefrom of said core upon said core being moved along said spindle away from said core support and to enable engagement of said core and said fingers upon said core being moved along said spindle toward said core support.

11. In combination, the combination of claim 10, and a cover over said core;

said spindle including cover support means for engaging and supporting said cover; said cover support means being on said spindle at a location outside said core and beyond said second end face thereof;

said cover being in opposed relationship to said core second end face and having a width in the radial direction of said core that is greater than the diameter of said core.

12. In combination, the combination of claim 10 and a mount therefor;

said mount comprising a support wall, an annular recess defined in said support wall; said annular recess having an annular wall therein which defines the inside wall of said recess; said recess inside wall being generally toothed for engaging and restraining pawls against free rotation around said recess;

projecting from the periphery of said core support is at least one pawl; said core support being positioned in said mount recess such that said pawl thereof engages said teeth in said mount recess; said pawl being so oriented that it permits said core support to rotate in only one direction, whereby said core, connected with said core support through said hooks, is thereby permitted only to rotate in one direction and by reason of the engagement of said pawls on said mount recess wall teeth, said spindle support and said core may rotate only a measured positively controllable amount.

* * * * *